United States Patent [19]

Lee et al.

[11] Patent Number: 5,066,363

[45] Date of Patent: Nov. 19, 1991

[54] METHOD OF FORMING PULP BALES WITH DISSOLVABLE PVA BALING STRAP MATERIAL

[75] Inventors: Richard P. Lee, Hagerstown, Md.; Joseph F. Ley, DePere, Wis.; John A. Mortensen, Little Silver, N.J.

[73] Assignee: C. M. Offray & Son, Inc., Chester, N.J.

[21] Appl. No.: 562,677

[22] Filed: Aug. 3, 1990

[51] Int. Cl.[5] ..... D21H 11/00

[52] U.S. Cl. ..... 162/100; 162/201; 206/83.5; 100/1; 241/46.17; 428/913

[58] Field of Search ..... 162/100, 201; 428/913, 428/2; 100/1; 206/83.5; 241/46.17; 493/379, 386

[56] References Cited

U.S. PATENT DOCUMENTS

| | | | |
|---|---|---|---|
| 3,330,409 | 7/1967 | Jorgensen | 206/83.5 |
| 3,556,919 | 1/1971 | Johns et al. | 428/913 |
| 3,652,371 | 3/1972 | Hirata | 428/913 |
| 3,654,064 | 4/1972 | Laumann | 428/913 |
| 4,267,016 | 5/1981 | Okazaki et al. | 162/157.4 |

*Primary Examiner*—Richard V. Fisher
*Assistant Examiner*—Todd J. Burns
*Attorney, Agent, or Firm*—Mark T. Basseches; Paula T. Basseches

[57] ABSTRACT

A method of processing pulp laps and a soluble strap material for holding such laps in a bale are disclosed. In accordance with the method the laps are maintained in the configuration of the bale by soluble straps comprised of PVA and are immersed in a pulping bath while still confined by the straps. The straps rupture and dissolve in the pulping bath releasing the paper laps. The straps are formed to maximize exposure of the PVA increments to the pulping bath to accelerate dissolving and may incorporate fillers of pulpable material to maintain the PVA increments in a separated condition.

10 Claims, 2 Drawing Sheets

FIG. 1
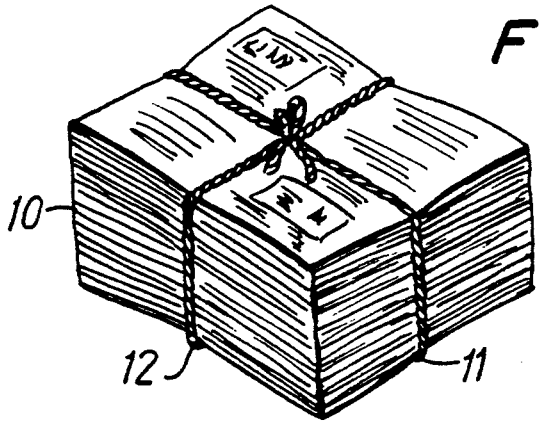
FIG. 2
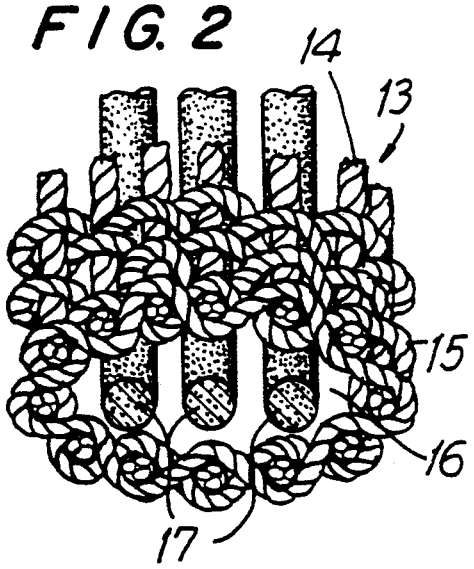
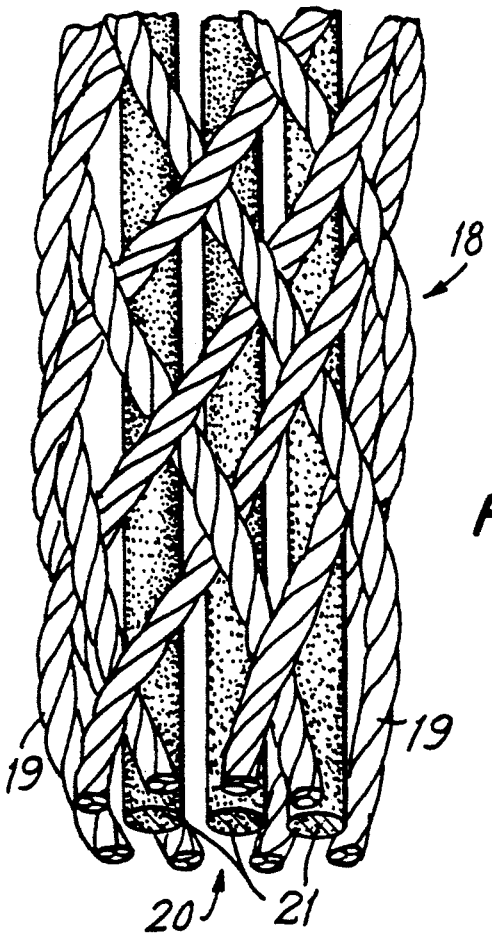
FIG. 3

FIG. 4
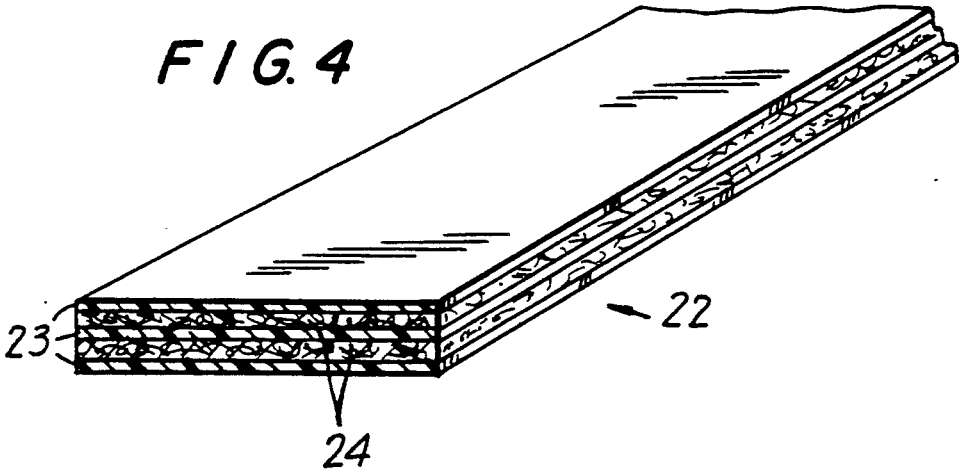
FIG. 5
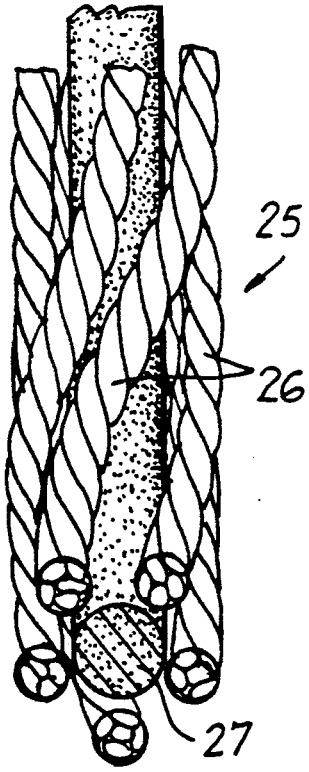
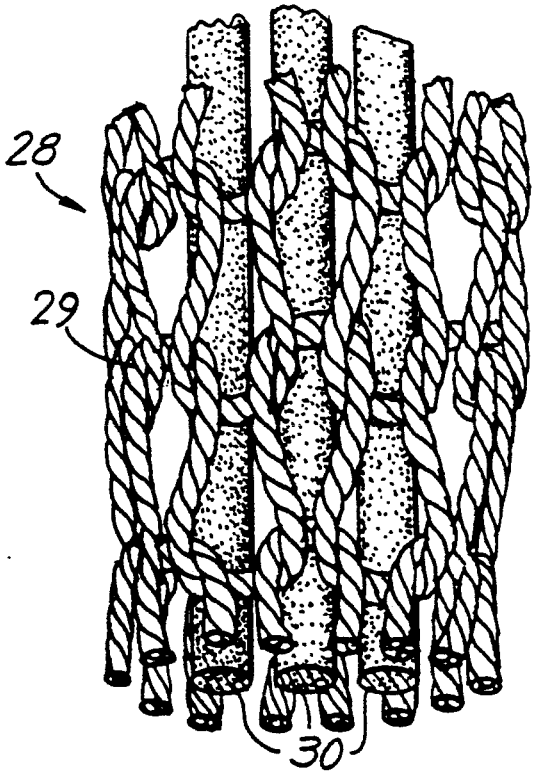
FIG. 6

METHOD OF FORMING PULP BALES WITH DISSOLVABLE PVA BALING STRAP MATERIAL

BACKGROUND OF THE INVENTION

1. Field of the Invention

The present invention is directed to the art of paper making and relates more particularly to the formation of bales of pulp laps, to the processing of such bales, and to a baling strap material.

2. Prior Art

The science of paper making and particularly the manufacture of paper from a furnish of wood fibers is an old and well developed art.

In general, a tree is debarked and reduced to pulp fibers which are cast into a slurry from which laps or sheets are formed. The sheets or laps of felted pulp are formed generally in a location near the logging operation, into bales of desired sized (e.g. 32×32×17 inches) which may range up to 600 pounds each The laps which may be dry or may incorporate a high moisture content e.g. 10% or more, are pressed to form the bales, which are then encircled with two or more wraps of wire, typically ⅛" galvanized wire. Where a high moisture content is present the freshly formed bales exhibit very high surface moisture content which may include standing water with resultant rust staining of surface laps.

The bales, which may thereafter be air or oven dried, are then shipped to the paper processing plant which, in the normal course, may be many miles from the baling side. The bales may be stored over protracted periods between shipping and use.

Upon arrival at the processing plant it is necessary to clip and remove the baling wire, generally at a location remote form the processing machinery, separation being necessitated in part by the fact that if any portion of the wire is inadvertently introduced into the succeeding processing step (pulping, beating and refining apparatus), the processing apparatus will be damaged, resulting in downtime, a wastage liquors and furnish, and possible repair of the complex beater mechanism which generally comprises rotating knives immersed in a slurry and moving in close proximity to stationary bars in the bath.

The operation of removing the baling wire is labor intensive and is widely recognized to constitute a highly hazardous procedure since the bale is in a somewhat compressed condition with the result that the snipped wires tend to spring violently away from the bale. In addition, the wires must be carefully removed to prevent contamination of the furnish and must be disposed of at in-ground waste disposal sites to conform to relevant regulations The cost of applying baling wire is estimated to amount to $0.50 per bale and by reason of the problems enumerated above, removal of the wire costs about $1.00 per bale. It is estimated that over 300,000 miles of baling wire material are used annually in the paper industry and that the costs of baling and wire removal approximate $50,000,000.00 per annum.

In addition to the cost inhering in the strapping and unstrapping of the bales, great difficulties are encountered in the handling of the bales after wire removal As noted, to avoid contamination, the unstrapping is carried out remotely from the processing apparatus and thus the cumbersome now loose pulp laps must be moved from the de-strapping to the processing location.

Notwithstanding the difficulties inhering in the handling of pulp bales by the conventional method described, such method has, for over a century, been the conventional means for processing the bales from formation to introduction in the paper making process.

It is known to fabricate packets of materials such as toxic chemicals in bags formed of PVA film whereby solutions of the chemicals may be made without handling the chemicals directly by simply immersing the packets in a container of water.

It is similarly known in order to minimize the handling of soiled linen to encompass the linen in non-sticky bags made of PVA.

Representative prior art references pertaining to PVA and its uses include the following:

2948,697 Robertson Aug. 9, 1960
3316,190 Suzumura et al Apr. 25, 1967
3374,195 Bianco et al Mar. 19, 1968
3425,972 Nobile et al Feb. 4, 1969
4119,604 Wysong Oct. 10, 1978
4155,971 Wysong May 22, 1979
4156,047 Wysong May 22, 1979
4206,101 Wysong June 3, 1980
4215,169 Wysong July 29, 1980
4267,145 Wysong May 12, 1981

SUMMARY OF THE INVENTION

The present invention may be summarized as directed to an improved method of forming bales of pulp laps and processing the same, as well as to the novel strapping or binding material used in the method.

Still more particularly the invention is directed to the use of a binding material comprised of soluble polyvinyl alcohol (PVA) yarns or filaments alone or intermixed with readily pulpable cellulosic materials.

In accordance with the method, the compressed pulp laps are encircled by soluble polyvinyl alcohol (PVA) strap fabricated into an open structure which will retain its open structure characteristic notwithstanding tensioning of the straps. The strap material is comprised of elongate filaments, yarns or strips alone or intermixed with readily pulpable materials, i.e. paper. A strap of PVA alone may be formed by a weaving method since the yarns forming woven fabrics are dimensionally stable when the fabric is stressed. The straps may be formed by other methods wherein the components tend to shift toward each other when tensioned, i.e. braids, ropes, knits etc., but in such cases the PVA is preferably intermixed with a pulpable absorbent material which will retain the spacing of the PVA materials.

The necessity for maintaining separation of the PVA components is to enable maximum access of the aqueous pulping solution to the PVA and hence the rapid dissolving of the strap to minimize the time required in the pulper since, in accordance with the invention, the bale is introduced directly into the pulper while still constrained by the soluble strap material.

Thus, in accordance with the method of the invention, the still constrained bales are introduced into the pulper or beater tank or into a precursor tank wherein the strap or binding material is dissolved, releasing the pulp laps for further processing, avoiding completely the dangerous and costly operation of wire snipping and disposal.

The method is replete with advantageous side effects, including the fact that the dissolved PVA represents a beneficial additive to the paper making slurry, augmenting the quality of the thus-formed paper, PVA being a common additive at a later stage of the paper processing.

In addition, since strapping material is sometimes applied at a time when the bale is compressed and the surfaces include high water content or, indeed, standing water, an additional benefit of the use of PVA strapping is that a form of adhesive connection inherently results whereby the strap material is not merely secured to the bale by the tensile encircling forces but is also surface bonded to the bale.

Accordingly, the quantity of strapping material employed to assure that the bale will remain as a discrete unit is less than might be expected if the bale were held together solely by the tensile strength of the strap material.

More specifically, it has been found that a binding strap comprised of PVA having a break strength of 100 pounds may be successfully employed to constrain pulp bales which heretofore employed wires having break strengths of about 700 pounds.

It is accordingly, an object of the invention to provide a novel method of forming pulp bales which comprises encircling the compressed pulp laps with a binding or strapping material comprised of discrete and spaced PVA yarns, filaments or strips.

The invention is further directed to a novel method of processing pulp bales of the type described which includes immersing the still strapped bales in the pulping mechanism, permitting the strapping materials to be dissolved in the beater bath, thereby eliminating the costly and hazardous operation of cutting baling wires and handling unconstrained pulp laps.

Still a further object of the invention is the provision of a strapping material for use in the methods hereinabove set forth, which strapping material is comprised of PVA yarns, strips or filaments formed into a strap characterized by a separation of the individual PVA components which provide the tensile strength of the strap to assure a maximum area for contact of the PVA components with the pulping bath to facilitate rapid dissolving of the strap Preferred embodiments of the strap material include a woven strap structure formed of PVA yarns, a roped or braided structure wherein the PVA yarns or filaments are maintained in a separated condition by absorbent pulpable material such as strips or twists of absorbent pulpable cellulosic material, or a multi-layer strap material formed of a plurality of thin PVA strips separated by layers of absorbent pulpable material

BRIEF DESCRIPTION OF THE DRAWINGS

FIG. 1 is a perspective view of a bale of pulp laps encompassed within strap material in accordance with the invention;

FIG. 2 is a schematic enlarged sectional view of a segment of woven strap material;

FIG. 3 is a view similar to FIG. 2 of a braided strap material;

FIG. 4 is a view similar to FIG. 2 of a multi-layered strap construction;

FIG. 5 is a view similar to FIG. 2 of a twisted cord strap construction;

FIG. 6 is a view similar to FIG. 2 of a knitted strap construction.

DETAILED DESCRIPTION OF THE DRAWINGS

Referring now to the drawings, there is shown in FIG. 1*a* bale 10 of pulp laps which has a configuration of a generally right parallelepiped. The bale 10 is lapped by straps 11, 12 encircling the bale in the longitudinal and widthwise directions, it being understood that while two encircling straps are illustrated, the number of straps may vary in accordance with such factors as the size and weight of the bale.

The strap components 11, 12 form a critical component of the instant invention and should have a break strength which is dependent upon the size and weight of the bale.

For large bales, i.e. in the range of 600 pounds, and encircled by two straps, a break strength of about 150 or more pounds is desired with lesser break strengths being acceptable for smaller bales.

Central to the invention is the provision of a strap material formed of soluble PVA yarns, filaments or like increments which is characterized in that the discrete increments forming the strap are maintained in a separated condition when subjected to elongating forces and when the same are immersed in a pulping bath.

As will be set forth more particularly hereinafter, a woven strap construction may be fabricated entirely of PVA warp, pick and stuffer yarns since a woven construction is resistant to constriction when tensioned.

Unlike woven structures, knitted, braided and corded strap structures, if formed entirely of PVA increments, would tend to coalesce when stretched and when they swell as a result of immersion in a pulping bath increasing the time of immersion. As will be noted hereinafter, such coalescing type structures may nonetheless be effectively employed as a strap material which rapidly disintegrates in a pulping bath by interdigitating the PVA components which provide the primary tensile strength of the strap material with readily pulpable cellulosic stuffer materials such as, by way of example, non-resin treated absorbent paper in twisted or untwisted form.

Referring now to the drawings, there is shown in FIG. 2, in schematic form for ease of illustration, a woven tubular strap material 13 comprised of warp ends 14 and weft ends 15 woven to define a tubular structure. The ends 14,15 are formed of PVA yarns, representative such yarns being described hereinafter in connection with the specific examples given Encompassed within the hollow core portion 16 of the woven tube there may optionally be provided a series of stuffer ends 17 formed a repulpable cellulosic material, e.g. resin free Kraft paper, preferably twisted, of a type known as raffia, a multi-filament absorbent cotton yarn, etc.

The specific characteristics of the stuffers 17 are unimportant except that the same must be readily pulpable when subjected to a conventional pulping bath and that the same be highly absorbent.

As will be appreciated hereinafter, it is the function of the stuffers to maintain the yarns, and particularly the warp yarns 14, in a separated condition one from the other and also to maximize the exposure of the yarns to the pulping bath whereby rapid dissolving of the yarns will be effected. As previously noted, a woven fabric may be used without included cellulosic separation since the yarn ends do not converge when tensed and thus a woven structure is at present preferred. Where a woven structure without repulpable materials is employed, a single layer fabric should be used.

FIG. 3 discloses a braided strapping material 18 wherein the longitudinally directed PVA yarns or twisted PVA strips 19 are interbraided about a central core 20 within which is housed the repulpable cellulosic stuffers 21.

In FIG. 4 the strap material 22 is comprised of a multiplicity of discrete PVA film layers 23, the absorbent cellulosic separator materials 24 in this instance being comprised of correspondingly sized strips of paper, i.e. a non-resin coated or impregnated absorbent Kraft paper.

In FIG. 5 there is shown a strap material 25 in the nature of a rope or twisted cord including spirally wound multi-filament PVA yarns 26 wrapped about a core 27 of the readily repulpable cellulosic material.

In FIG. 6 there is disclosed a schematic representation of a knitted strap material 28 wherein the knitted yarns 29 of PVA are formed into a tubular structure encompassing longitudinally directed stuffer ends 30.

The above illustrations are not to be considered limitative since, as will be apparent to those skilled in the fabric and/or strapping and rope forming arts, alternate strap constructions will suggest themselves in the light of the instant disclosure.

By way of example, and in compliance with the requirements of the patent laws, there will hereinafter be set forth representative specific strap constructions which, as noted, are not to be taken in a limitative sense.

EXAMPLE 1

Woven Strap

A strapping fabric was made entirely of PVA yarns as follows:

A strap of ¼" width is constructed of 20 warp ends of 800 denier PVA in a tubular construction using 800 denier stuffer yarns and 100 denier PVA filling yarns woven at 40 picks per inch.

The construction is tubular in nature, comprising 2 series of weft and 2 series of warp yarns, one of each forming the upper and lower fabric defining the tube. By interweaving the face picks only with the face ends and the backing picks only with the backing ends, two distinct fabrics are formed, one above the other.

In producing this structure there is an open center containing the 8 stuffer yarns which are in no way attached to the face or back fabrics The tensile strength of the product is augmented by the presence of the stuffer yarns while keeping fabric density to a minimum.

Suitable PVA yarns may be obtained from Nitiry Company, Ltd. of Tokyo, Japan, such material being distributed in the United States by Hickory Dyeing and Winding Company, Inc., Hickory, N.C.

The yarns are available in a preferred multi-filament configuration. Monofilament yarns are also available but generally, unless pulping is effected at high temperature, the multi-filament yarns are preferred due to their tendency to dissolve more rapidly.

The selection of a specific yarn should be effected in accordance with the nature of the pulping process to which the bale will be subjected since the composition of the PVA material determines such characteristics as the rapidity with which it will dissolve and its tensile strength.

In general, the lower the temperature at which the yarn rapidly dissolves the lower the tensile strength of the yarn. Accordingly, it may be desirable to employ a high temperature dissolving, high tensile strength yarn where pulping is to be carried out at relatively high bath temperatures or highly acidic consetions. Where lower bath temperatures are employed it may be necessary to use lower temperature dissolving and, hence, less strong yarns, requiring the employment of more lengthwise yarns to achieve the necessary strap break strength.

The above described strap material was employed to bale 500 sheets of wood pulp measuring approximately 33"×33"×17" high and having a moisture content of about 7½%, the bale weighing approximately 550 pounds The bale was encompassed utilizing 2 straps of a woven PVA fabric as described, with one widthwise encircling strap and one strap encircling the lengthwise dimension. The straps were applied while the pulp bale was in a compressed state.

The straps themselves exhibited a break strength of about 150 pounds and satisfactorily maintained the integrity of the bale under conventional shipping and handling procedures. This was so despite the fact that the strap had only approximately 15% of the tensile strength of conventional steel baling wire.

The satisfactory performance of the strap from a structural standpoint is considered to derive from the longitudinal elasticity thereof.

The described bales was introduced into a conventional pulping tank containing water at 90° F. (32° C.) and a pH approximately 6. The tank included a bottom mounted agitator. Within approximately 1 minute the baled contents had completely separated, signifying that the straps had dissolved at least to the extent that the same ruptured.

An inspection of the tank contents after 15 minutes in the bath failed to show any evidence of the strap material. The pulp was formed into a slurry suitable for further processing after a total of 20 minutes.

In view of the substantial expense involved in testing of strap materials employing actual bales and subjection of the strapped bales to an actual pulping operation, a test was devised whereby alternate strap materials were equated in their various characteristics to the strap material of Example 1.

Specifically, a length of material to be tested was tested as to tensile strength and resilience and the material to be tested immersed under tension in an agitated heated water bath at a temperature and acidity corresponding to the temperature and acidity of a pulping tank.

EXAMPLE 2

A braided product was produced using PVA film 0.002" thick slit into ¾" wide strips, 8 of which were braided together into a loose braid tube approximately ⅜" in diameter. A length of the braided product was immersed in a laboratory bath at the temperature and pH value noted in Example 1 under tension of approximately 80 pounds. The braid ruptured within 50 seconds and dissolved completely within 5 minutes.

The strap material of Example 2 was formed as before except that a core of loosely twisted resin free absorbent Kraft paper material of approximately ¼" diameter was encompassed within the tubular braid structure. Rupture was noted within 30 seconds and the PVA material dissolved completely within about 3½ minutes.

EXAMPLE 3

PVA films of 0.003" thickness and 1" wide were stacked one upon the other, with absorbent Kraft paper layers of equal width and length to the film strips being sandwiched between adjacent PVA strips. A structure of 150 pound break strength required 6 layers of PVA. The thus formed strap material was tested in accordance with Example 2, with rupture occurring in approximately 60 seconds and complete dissolving of the PVA in approximately 4 minutes.

EXAMPLE 4

A rope type structure was formed by first twisting 8 ends of 300 denier PVA filaments in the 'Z' direction and then, using 8 of such multi-filaments, a rope was formed by cabling such ends in the 'S' direction about a core of absorbent repulpable Kraft paper twisted and having an average diameter of about 3/16".

The break strength of the rope was approximately 125 pounds and when subjected to the test per Example 2 ruptured in about 60 seconds and dissolved completely in about 5 minutes, the paper core having been pulped within the same 5 minute time frame.

As will be apparent from the foregoing description there is provided in accordance with the present invention a novel method of baling pulp laps which eliminates the dangerous operation of removing baling wires. The PVA materials form a useful component of the pulping bath, such material being a common additive to paper formulations at a later stage of manufacture.

Numerous variations of specific strap structures will occur to persons skilled in the art, the objective being in all instances to provide sufficient break strength in a strap which will rapidly dissolve. A further advantage to the strap where applied to a bale having a high surface moisture content is the tendency of the strap to adhere to the bale surface, providing a more stable bale structure. Attempts to encase the bales in films have proven unsatisfactory due to the large amount of film required and the formation of local ruptures due to irregularity of the wood pulp laps.

Since the straps may take many forms, the invention is to be broadly construed within the scope of the appended claims.

Having thus described the invention and illustrated its use, what is claimed as new and is desired to be secured by Letters Patent is:

1. The method of handling and processing a bale of paper pulp laps which comprises binding a bale with one or more discrete straps, said straps comprising elongate increments of PVA yarns, PVA filaments or PVA strips maintained in mutually spaced condition, and thereafter immersing said bale in a pulping bath while still constrained by said strap or straps, whereby said PVA increments dissolve in said bath.

2. The method in accordance with claim 1 wherein said strap or straps are formed by weaving.

3. The method of claim 1 wherein said strap or straps are comprised of said elongate increments of PVA interspersed with pulpable absorbent material, said material being arrayed between said increments to maintain said PVA increments in said mutually spaced condition.

4. The method of claim 3 wherein said absorbent material is a cellulosic material.

5. The method in accordance with claim 3 wherein said strap or straps are comprised of a braid formed of said increments of PVA and increments of said pulpable absorbent material.

6. The method in accordance with claim 3 wherein said strap or straps are comprised of a rope incorporating said increments of PVA and said pulpable absorbent material.

7. The method of claim 3 wherein said strap or straps are comprised of a fabric incorporating said increments of PVA and said pulpable absorbent.

8. The method in accordance with claim 3 wherein said strap or straps are comprised of alternate layers of strips of PVA film and strips of said pulpable absorbent material.

9. The method of claim 3 wherein said pulpable absorbent material comprises paper.

10. The method of handling and processing a stack of moisture containing paper pulp laps comprising providing one or more discrete straps comprised of elongated increments of PVA yarns, PVA filaments or PVA strips mounted in mutually spaced relation, encircling said straps about a stack to bind said stack into a structurally secure bale with at least certain portions of said increments of PVA contacting and being locally bonded to the contacted portions of said bale as a result of the interaction of the moisture of said bale and said contacted PVA increments, and thereafter immersing said bale in a pulping bath while still contained by said strap or straps whereby said PVA increments dissolve in said bath and are integrated into the pulp material in said bath.

* * * * *